United States Patent [19]

Hund, Jr.

[11] Patent Number: 4,759,257

[45] Date of Patent: Jul. 26, 1988

[54] POWER UNIT PARTICULARLY FOR REFUSE CONTAINER PACKER MECHANISM

[75] Inventor: Henry M. Hund, Jr., Knoxville, Tenn.

[73] Assignee: Dempster Systems Inc., Toccoa, Ga.

[21] Appl. No.: 7,276

[22] Filed: Jan. 27, 1987

[51] Int. Cl.[4] ..... F15B 11/18

[52] U.S. Cl. ..... 91/168; 91/189 R; 137/119; 92/52; 92/53

[58] Field of Search ..... 91/167 R, 168, 189 R; 92/52, 53; 137/119

[56] References Cited

U.S. PATENT DOCUMENTS

| | | | |
|---|---|---|---|
| 2,438,285 | 3/1948 | Houldsworth | 60/52 |
| 2,453,350 | 11/1948 | Stegeman | 91/167 |
| 2,701,551 | 2/1955 | Gunning et al. | 91/167 |
| 3,168,853 | 2/1965 | Prince | 91/1.67 |
| 3,170,377 | 1/1965 | Herpich et al. | 91/169 |
| 3,524,465 | 8/1970 | Sadler | 137/119 |
| 3,604,446 | 9/1971 | Brooks | 137/119 |
| 3,691,904 | 9/1972 | Pesci | 91/189 |
| 3,696,712 | 10/1972 | Sung | 92/52 |
| 3,819,071 | 6/1974 | Liberman | 214/83.3 |
| 4,173,424 | 11/1979 | Whitehead et al. | 100/51 |
| 4,396,342 | 8/1983 | Henderson | 414/511 |

FOREIGN PATENT DOCUMENTS 8130251 12/1981 European Pat. Off. .

*Primary Examiner*—A. Michael Chambers

*Attorney, Agent, or Firm*—Jacox & Meckstroth

[57] ABSTRACT

A fluid operable power unit which is particularly adapted for movement of a compaction head in a refuse container. However, the power unit is also useful in other types of mechanism.

The power unit comprises a plurality of telescopically movable cylinders and pistons. Fluid pressure is applied for movement of the first cylinder. Then increased fluid pressure is applied for movement of the second cylinder. As the first cylinder ceases to move, fluid pressure increases and automatically operable valve means traps the fluid which has moved the first cylinder. Then increased fluid pressure moves the second piston and second cylinder. As the second piston and the second cylinder move under the influence of increased fluid pressure, the fluid which is trapped is increased in pressure.

Thus, high pressure forces act to move an actuator member for compaction or for any other purpose.

10 Claims, 4 Drawing Sheets

POWER UNIT PARTICULARLY FOR REFUSE CONTAINER PACKER MECHANISM

BACKGROUND OF THE INVENTION

One type or style of a refuse container is that in which the container has an opening in the upper portion thereof. Refuse is dumped into the container through the opening. Then a packer mechanism compacts the refuse by moving the refuse in a direction away from the opening.

Packer mechanisms and power units therefor have been created to provide a high degree of compression and compaction upon refuse within a refuse container.

It is an object of this invention to provide a power unit for refuse container packer mechanism which is capable of a very high magnitude of compaction forces in consideration of the physical size of the power unit.

Another object of this invention is to provide such a power unit which is capable of operation at a relatively high rate.

Another object of this invention is to provide such a power unit which is relatively simple in construction and which can be constructed and maintained at relatively low costs.

Another object of this invention is to provide such a power unit which can be employed in various types of situations.

Other objects and advantages of this invention reside in the construction of parts, the combination thereof, the method of production and the mode of operation, as will become more apparent from the following description.

SUMMARY OF THE INVENTION

A power unit of this invention is of the type which moves a compaction head along between the ends of a refuse container for packing the refuse and for removing the compacted refuse from the refuse container. The power unit is attached to the interior of the refuse container and to the compaction head.

The power unit of this invention comprises a housing provided with a chamber therein. A first piston of a given transverse dimension is positioned within the chamber. Attached to the first piston and coaxial therewith are spaced-apart coaxial cylinders. A second piston which has a smaller transverse dimension than the first piston is also within the chamber and is coaxial with the first cylinder and is between the cylinders which are attached to the first piston.

Fluid is introduced through a main passage of the housing for operation of the pistons. A valve mechanism is located within the main passage. The fluid is conducted into the main passage and then through an auxiliary passage into a space between the cylinders which are attached to the first piston, for movement of the second piston or smaller piston, for initial operation of the power unit and for initial movement of a compaction head which is attached to the power unit. Fluid which moves the first piston or smaller piston is of a given initial pressure. This fluid of the given pressure moves the smaller piston until this fluid pressure is unable to move the smaller piston farther.

Then the pressure of fluid flowing into the main passage increases. This increase in fluid pressure causes valve operation in the main passage which closes the auxiliary passage and closes fluid between the main passage and to the smaller piston. Thus, fluid which has moved the smaller piston is trapped within the chamber of the housing. The valve operation within the main passage almost simultaneously opens a second auxiliary passage for flow of fluid to the first piston or larger piston. The larger piston then moves, and applies increased pressure upon the fluid which is trapped within the chamber and which is engaging the smaller piston. Thus, increased pressure is applied to the smaller piston for additional movement of the compaction head.

DETAILED DESCRIPTION OF THE INVENTION

Figure 1:
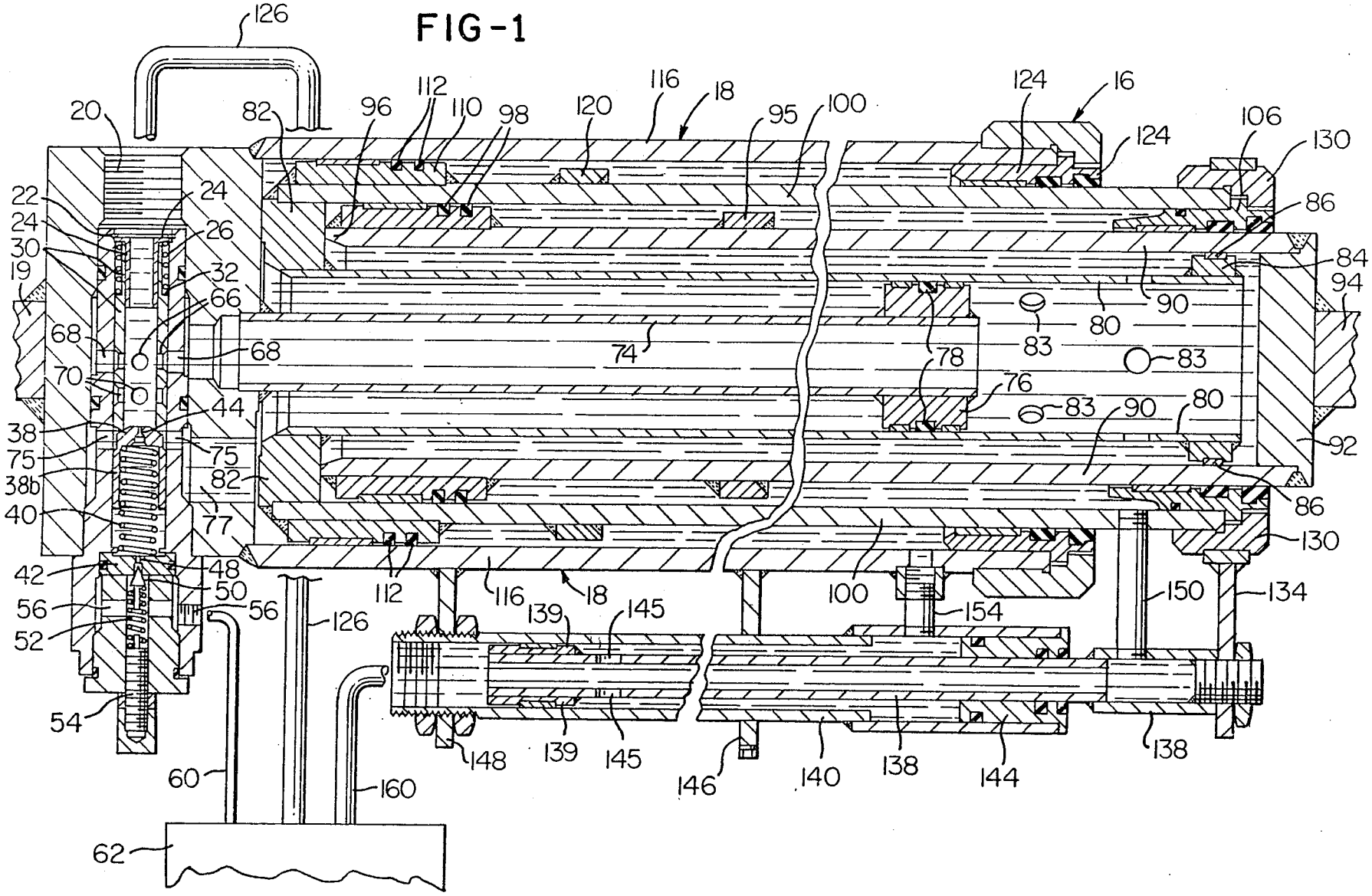
FIG. 1 is a side sectional view of a power unit of this invention, showing the parts thereof in deactuated positions.

FIGS. 1–5 show in detail a power unit 16 of this invention. The power unit 16 comprises an elongate housing 18. Attached to the elongate housing 18 is a mounting bracket 19. Adjacent the mounting bracket 19, the elongate housing 18 is provided with a main fluid passage 20. Within the main fluid passage 20, at the upper part thereof, is an annular snap-ring 22. A cup shaped retainer 24 is also within the main passage 20 and is encompassed by a coil spring 26. The cup-shape retainer 24 has a part which is engaged by the coil spring 26 and is urged by the coil spring 26 into engagement with the snap-ring 22. The cup-shape retainer 24 is also encompassed by a tubular valve member 30, which has a part encompassed by the coil spring 26. Thus, part of the tubular valve 30 encompasses the cup-shape retainer 24. The coil spring 26 engages a shoulder 32 formed on the tubular valve 30 and urges the tubular valve 30 in a direction away from the snap-ring 22.

The tubular valve 30 extends along the main passage 20 and has an end portion engaged by an abutment valve 38. The abutment valve 38 has a cylindrical extension part 38*b* extending downwardly therefrom and which encompasses a coil spring 40. The coil spring 40 engages the abutment valve 38. The coil spring 40 also engages a wall 42, shown at the lower portion of the main passage 20. The coil spring 40 thus urges the abutment valve 38 toward the tubular valve 30. The abutment valve 38 has an orifice 44 therethrough. The wall 42 has an orifice 48 therethrough. The orifice 48 is larger than the orifice 44.

Normally positioned within the orifice 48, and closing the orifice 48, is a dart valve 50. The dart valve 50 is engaged by a coil spring 52. The coil spring 52 also engages an adjustment screw 54. The coil spring 52 urges the dart valve 50 into the orifice 48. The dart valve 50 and the coil spring 52 are within an outlet passage 56. The outlet passage 56 is in communication with a return conduit 60 which leads to a fluid reservoir 62.

The tubular valve 30 has a cylindrical wall, provided with openings 66 therein which are normally in communication with internal passages 68 within the housing 18. The cylindrical wall of the tubular valve 30 also has openings 70 which are spaced axially from the openings 66. The openings 70 are normally closed by the cylindrical internal walls of the main passage 20.

The internal passages 68 are in communication with a tubular conduit 74 which is within the housing 18 and attached thereto. The housing 18 also has internal passages 75, which are shown in FIG. 1 adjacent the abutment valve 38. The internal passages 75 are normally closed by the abutment valve 38, as shown in FIG. 1. The internal passages 75 lead to a passage 77, which leads into the housing 18. The tubular conduit 74 has attached thereto an annular encompassing collar 76 which supports a seal member 78. The collar 76 is encompassed by a cylinder 80 which has attached thereto a piston 82. The piston 82 encompasses the cylinder 80. The cylinder 80 has openings 83 therethrough. Encompassing the cylinder 80 and attached thereto is a guide collar 84. The guide collar 84 has attached thereto a slide member 86.

Encompassing the guide collar 84 is a cylinder 90 which has an end wall 92 external of the housing 18. A connector bracket 94 is attached to the end wall 92.

Encompassing the cylinder 90 and attached thereto is a ring 95. Attached to the cylinder 90 at the end thereof opposite the end wall 92 is a piston 96. Seal members 98 are attached to the piston 96. The seal members 98 engage a cylinder 100 which encompasses the piston 96. The cylinder 100 is attached to the piston 82 Thus, the piston 96 and the cylinder 90 are between the cylinders 80 and 100 which are attached to the piston 82. Attached to the cylinder 100 and slidably encompassing the cylinder 90 is a seal unit 106.

A conduit 126 leads from the reservoir 62 to the main passage 20 of the housing 18. Suitable pump means, not shown, are employed to pump fluid from the reservoir 62.

Encompassing the cylinder 100 and attached thereto, adjacent the piston 82, is a collar 110 which has attached thereto seal members 112. The seal members 112 and the collar 110 slidably engage a cylindrical wall 116 of the elongate housing 18. Also, encompassing the cylinder 100 and attached thereto is a ring 120. Attached to the cylindrical wall 116 adjacent the end thereof is an annular seal unit 124 which encompasses and engages the cylinder 100.

Attached to the cylinder 100 at the end thereof and adjacent the seal unit 106 is a collar 130. Attached to the collar 130 is a bracket 134. The bracket 134 has attached thereto a rigid conduit 138, which extends into a conduit housing 140.

Within the conduit housing 140 and attached thereto is a seal unit 144 which encompasses and slidably engages the rigid conduit 138. Encompassing the rigid conduit 138 and attached thereto and positioned within the conduit housing 140 is a seal unit 139. Adjacent the seal unit 139 the rigid conduit 138 is provided with openings 145. The seal unit 139 slidably engages the internal walls of the conduit housing 140.

The conduit housing 140 is attached to brackets 146 and 148, which are also attached to the elongate housing 18. A connector conduit 150 extends from the cylinder 100 and into the rigid conduit 138 for fluid communication therebetween. A connector conduit 154 extends from the housing 18 to the conduit housing 140, for communication between the housing 18 and the conduit housing 140. The conduit housing 140 has attached thereto, in communication therewith, a conduit 160, which is also joined to the reservoir 62 for communication between the conduit housing 140 and the reservoir 62.

Figure 6:
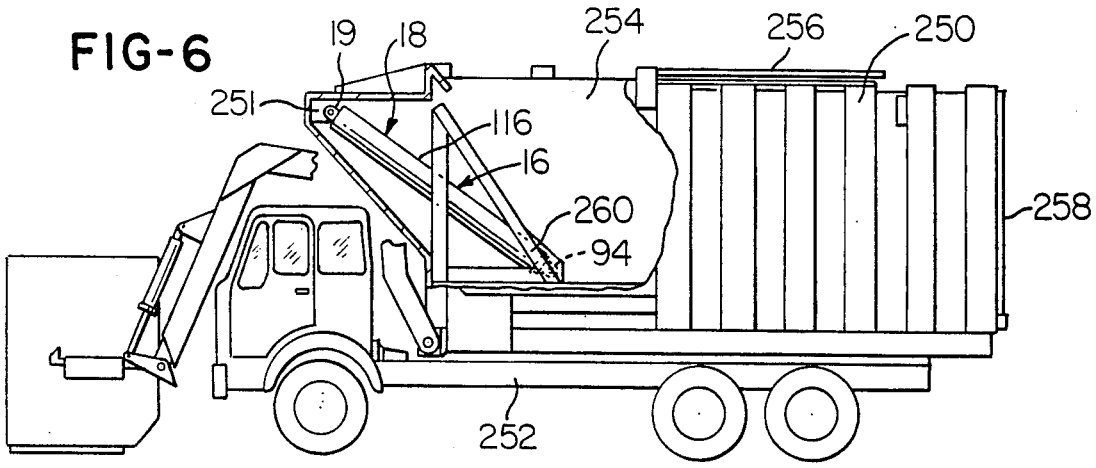
FIG. 6 is a side sectional view, with parts broken away, drawn on a smaller scale than FIGS. 1–5 and showing a refuse container vehicle in which the refuse container is provided therewithin with a compaction head. This view shows a power unit of this invention attached to the compaction head for movement of the compaction head. This figure shows the position of the compaction head and the power unit prior to a packing operation.
Figure 7:
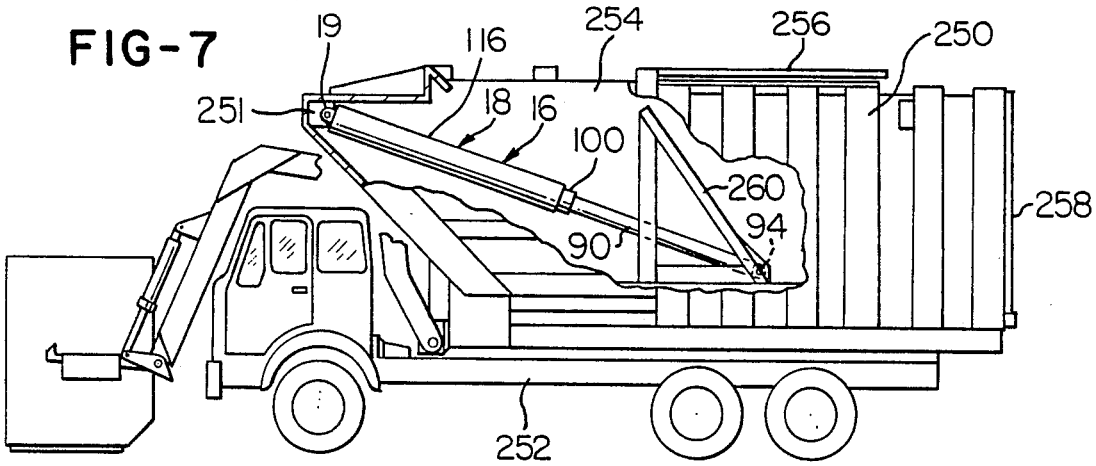
FIG. 7 is a side sectional view, with parts broken away, similar to FIG. 6, and showing the position of the compaction head and the power unit following the first stage of the packing operation.
Figure 8:
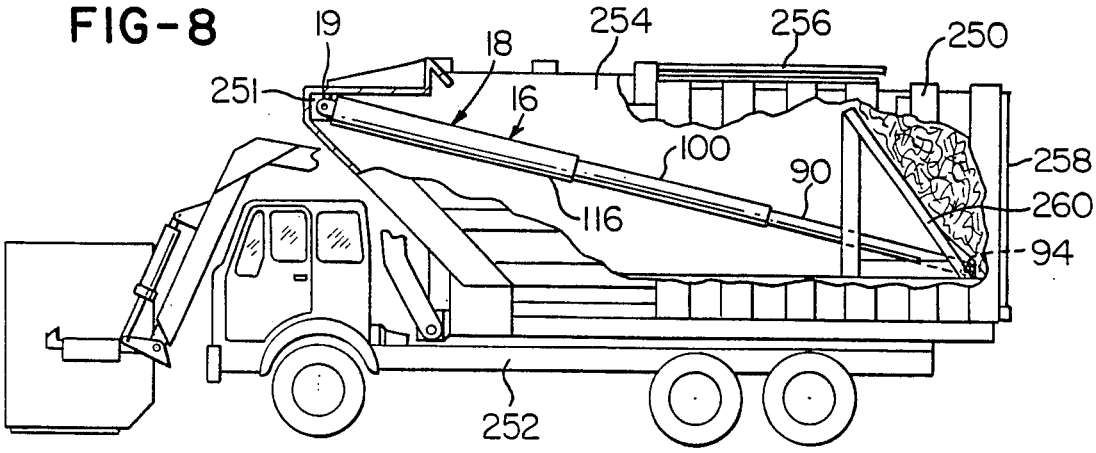
FIG. 8 is a side sectional view, with parts broken away, similar to FIGS. 6 and 7, and showing the position of the compaction head and the power unit following the second stage of packing operation.

As shown in FIGS. 6, 7, and 8, the power unit 16 is mounted within a refuse container 250. The mounting bracket 19 of the housing 18 is pivotally attached to an inner forward end part 251 within the refuse container 250. The refuse container 250 is shown herein as being mounted upon a vehicle 252. However, if desired, the refuse container 250 may be one which is not mounted upon a vehicle. The refuse container 250 has an opening 254 in the upper portion thereof. The opening 254 is closed by a movable cover member 256. The cover member 256 is shown in an open position. The refuse container 250 also has a gate 258 at the rear end thereof, through which refuse is ejected when the gate 258 is open.

Within the refuse container 250 is a compaction head 260 which is movable along the length of the interior of the refuse container 250. Pivotally attached to the compaction head 260 is the connector bracket 94 which is attached to the end wall 92 of the cylinder 90.

Refuse is dumped into the refuse container 250 through the opening 254. Then the power unit 16 is operated to move the compaction head 260 toward the rear of the refuse container 250 for compaction of the refuse.

In the operation of the power unit 16 for movement of the compaction head 260 fluid from the reservoir 62 is forced through the conduit 126 and into the main passage 20 of the housing 18. The fluid flows through the tubular valve member 30. Fluid flows from the tubular valve member 30 through the orifice 44 of the abutment valve 38. Fluid flows to the wall 42 but cannot flow through the orifice 48 because the dart valve 50 closes the orifice 48. Fluid flows outwardly from the tubular valve member 30 through the openings 66 in the tubular valve member 30.

As shown in FIG. 1, the openings 66 of the tubular valve member 30 are in alignment and communication with the internal passage 68. Therefore, fluid flows out of the tubular valve member 30, through the openings 66 thereof and through the passage 68 and into the tubular conduit 74. The fluid flows through the tubular conduit 74 and from the tubular conduit 74 into the cylinder 80 and engages the end wall 92 of the cylinder 90. The fluid also flows through the openings 83 in the cylinder 80 and into the cylinder 90. The fluid flows into the space between the cylinder 80 and the cylinder 100. The fluid flows between the piston 82 and the piston 96 and applies pressure upon the piston 96.

Figure 2:
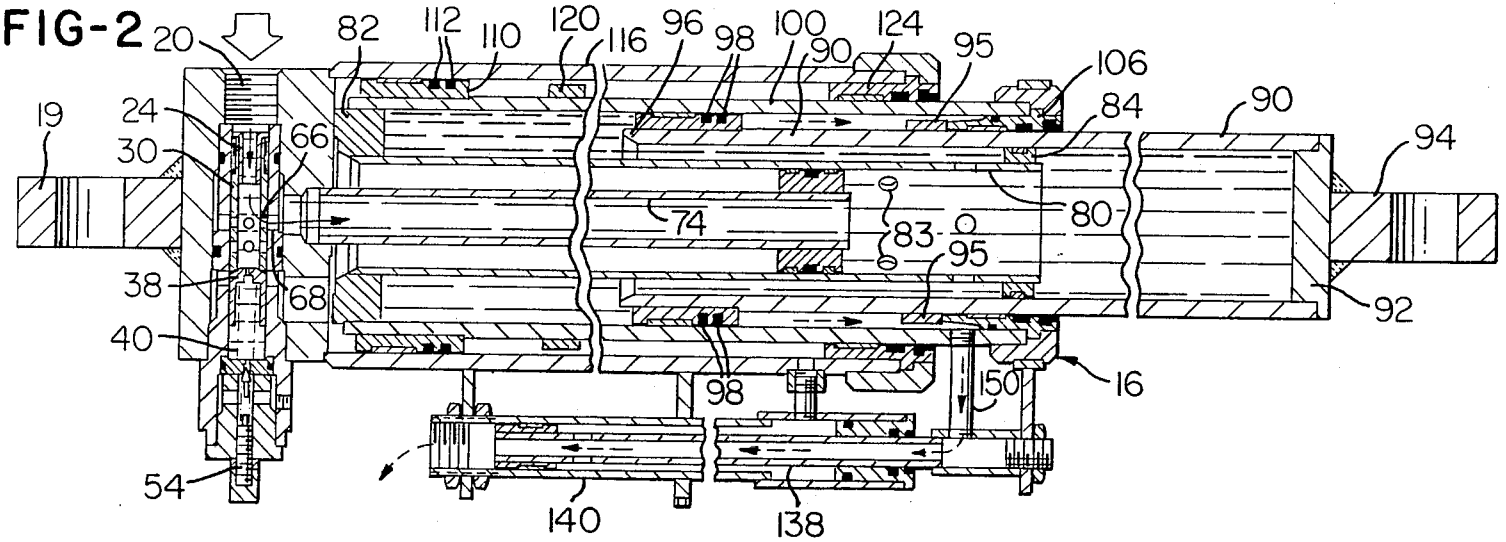
FIG. 2 is a side sectional view, drawn on a smaller scale than FIG. 1, but similar to FIG. 1, and showing the power unit of this invention in its first stage of operation.

The pressure of the fluid upon the piston 96 and upon the end wall 92 forces the piston 96 and the cylinder 90 to move to the right as illustrated in FIG. 2. The cylinder 90 moves to the right until the resistance of the compaction head 260 prevents further movement or until the ring 95 abuttingly engages the seal unit 106, is shown in FIG. 2. Thus, the compaction head 260 is moved from the position thereof shown in FIG. 6 to the position thereof shown in FIG. 7.

Figure 3:
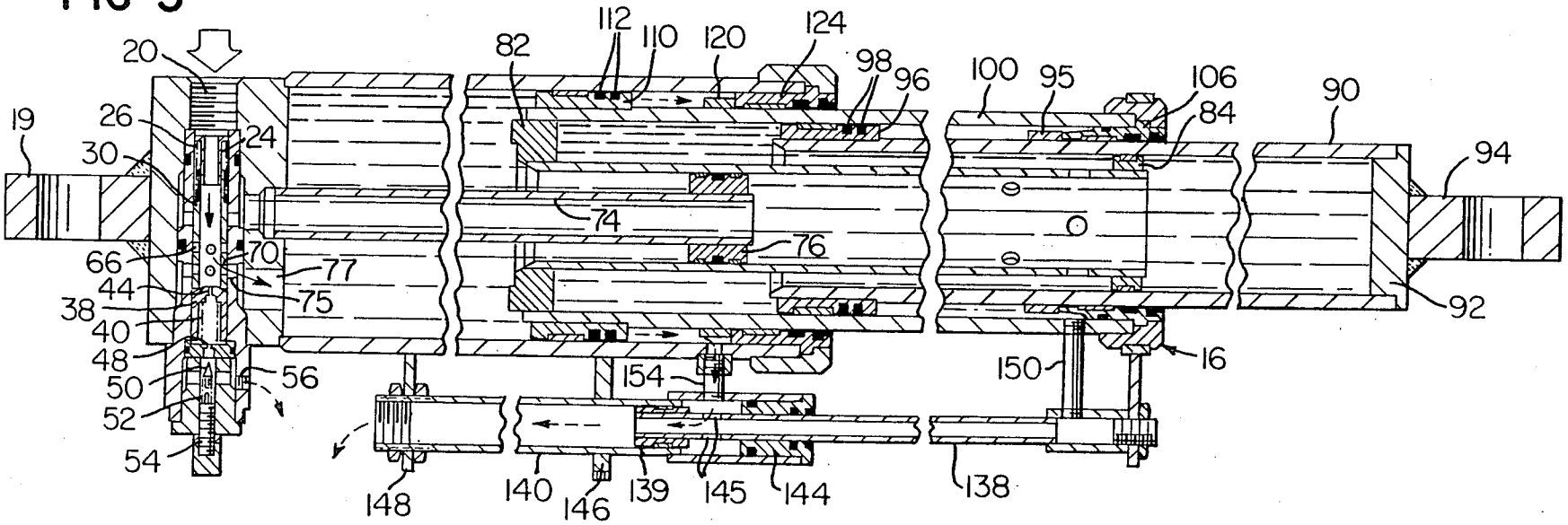
FIG. 3 is a side sectional view, similar to FIGS. 1 and 2, drawn on substantially the same scale as FIG. 2, showing the power unit in its second stage of operation.

When the cylinder 90 is positioned as shown in FIG. 2, the cylinder 90 is extended to its maximum position with respect to the cylinders 80 and 100. No additional movement of the cylinder 90 with respect to the cylinders 80 and 100 is possible. However, fluid pressure applied within the main passage 20 continues, and fluid pump pressure is capable of applying increased fluid pressure within the main passage 20. When fluid pressure within the main passage 20 increases, increased fluid pressure is exerted through the orifice 44 of the abutment valve 38. Also, increased fluid pressure is exerted upon the end wall 42 and into the orifice 48 of the end wall 42. Thus, the dart valve 50 is forced away from the orifice 48, and the orifice 48 is opened for flow of fluid therethrough, as shown in FIG. 3.

The orifice 48 in the end wall 42 is larger in area than the orifice 44 in the abutment valve 38. Therefore, fluid flows through the orifices 44 and 48, and fluid pressure imbalance occurs. As a result of fluid pressure imbalance, fluid pressure upon the abutment valve 38 moves the abutment valve 38 downwardly within the main passage 20, as shown in FIG. 3. Such downward movement of the abutment valve 38 is against the forces of the spring 40. When the abutment valve 38 moves downwardly, the spring 26 moves the tubular valve 30 downwardly, as the tubular valve 30 remains in engagement with the abutment valve 38.

Fluid which flows through the orifice 48 flows outwardly through the outlet passage 56 and into the return conduit 60. Then the fluid flows through the conduit 60 into the reservoir 62.

When the abutment valve 38 moves downwardly and the tubular valve 30 moves downwardly, the openings 66 in the tubular valve 30 are moved from communication with the internal passage 68. Thus, the openings 66 in the tubular valve 30 are closed. Therefore, the entrance to the internal passage 68 is closed by the cylindrical wall of the tubular valve 30, as shown in FIG. 3. Therefore, all the fluid which has entered the housing 18 through the passage 68 is trapped within the housing 18. The trapped fluid comprises fluid within the tubular conduit 74, within the cylinder 90 and between the cylinders 80 and 100.

Also, downward movement of the tubular valve 30 moves the openings 70 of the tubular valve 30 into communication with the internal passage 75, as shown in FIG. 3. Therefore, high pressure fluid flows from the tubular valve 30 through the openings 70 and into the passage 75 and into the passage 77 within the housing 18, as illustrated in FIG. 3. This fluid engages the piston 82. Thus, high pressure fluid is applied to the piston 82, and the piston 82 is moved to the right, as shown in FIG. 3. Movement of the piston 82 to the right applies pressure upon fluid which is within the cylinder 90 and which is located between the cylinders 100 and 80 and upon the fluid between the piston 82 and the piston 96.

The pressure of the trapped fluid is increased as the piston 82 moves toward the right and toward the piston 96, and applies pressure upon the trapped fluid as shown in FIG. 3. In view of the fact that the piston 82 is significantly larger in area than the piston 96, the increased fluid pressure applied for movement of the cylinder 90 is significant. Thus, the piston 82, the cylinder 90 and the end wall 92 and the connector bracket 94 are moved farther to the right, as shown in FIG. 3. Thus, the forces moving the compaction head 260 toward the right from the position shown in FIG. 2 to the position shown in FIG. 3 are greater than the forces moving the compaction head 260 from the position thereof shown in FIG. 1 to the position thereof shown in FIG. 2. Thus, the compaction head 260 is moved farther toward the rear of the refuse container 250, as illustrated in FIG. 3.

As the pistons 96 and 82 move toward the right, as shown in FIGS. 2 and 3, fluid within the housing 18 is forced therefrom through the connector conduits 154 and 150 and into the conduit housing 140, as illustrated in FIGS. 2 and 3. The fluid flows from the conduit housing 140 into the conduit 160 and flows into the reservoir 62. As the cylinder 100 moves toward the right as shown in FIG. 3, the rigid conduit 138 slidably moves outwardly with respect to the conduit housing 140. Thus, fluid communication between the rigid conduit 138 and the conduit housing 140 continues as the cylinder 100 moves to the right, as illustrated in FIG. 3.

FIG. 8 illustrates the maximum rearward position of the compaction head 260 as the cylinders 90, 80, and 100 are in the maximum extended position thereof.

When it is desired to discharge refuse from the refuse container 250, the gate 258 is opened, and the compaction head 260 is moved rearwardly by operation of the power unit 16. In the position of the compaction head 260 shown in FIG. 8 refuse within the container 250 can be forced from the container 250 when the gate 258 is opened.

Figure 5:
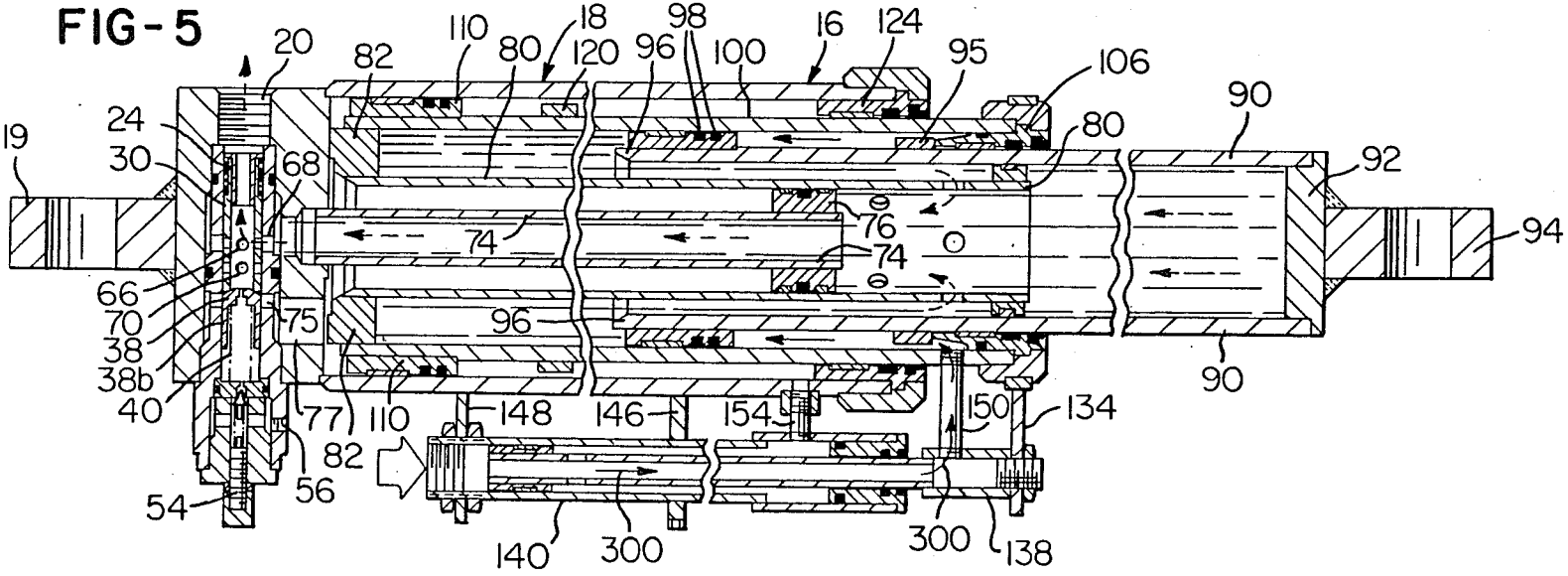
FIG. 5 is a side sectional view drawn on substantially the same scale as FIGS. 2, 3, and 4 and illustrating the second stage of return movement of the power unit.

When it is desired to move the compaction head 260 toward the left, fluid pressure ceases to be forced into the main passage 20 through the conduit 126. When fluid pressure into the main passage 20 through the conduit 126 ceases, the dart valve 50 is returned to its position within the orifice 48 by the spring 52, and the spring 40 moves the abutment valve 38 and the tubular valve 30 upwardly to their normal positions as shown in FIGS. 1, 2, and 5. Thus, the openings 66 in the tubular valve 30 are again in communication with the passage 68, and the abutment valve 38 returns to its position closing the passage 75.

Figure 4:
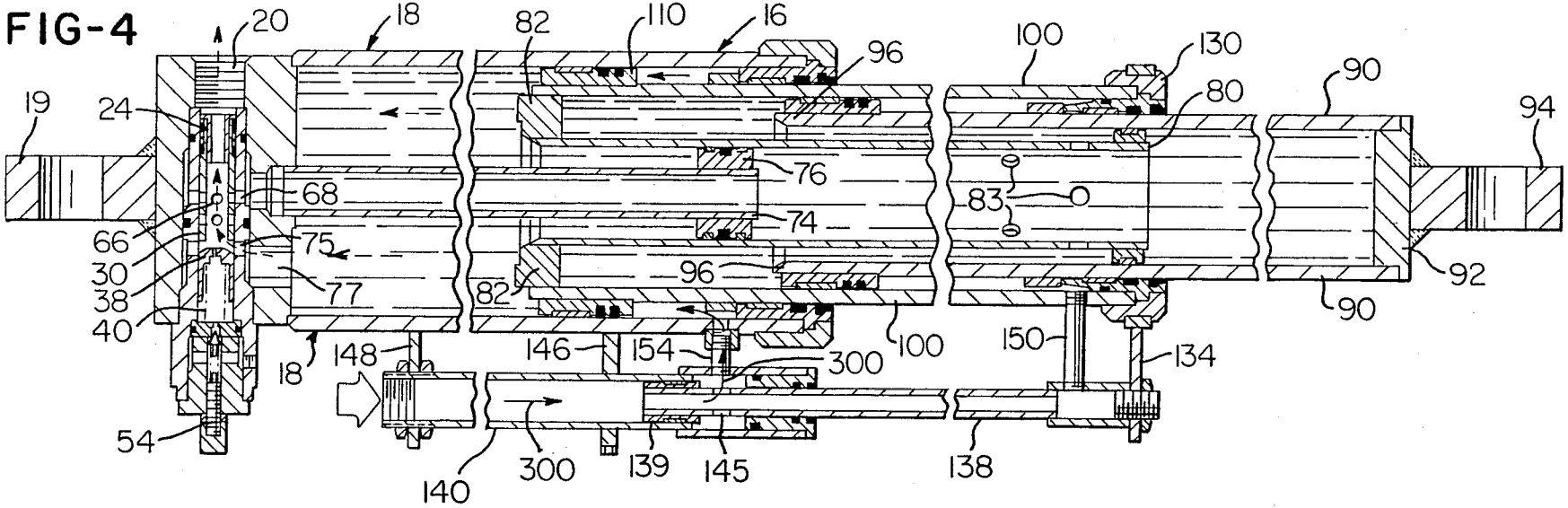
FIG. 4 is a side sectional view, drawn on substantially the same scale as FIGS. 2 and 3, and illustrating the first stage in return movement of the power unit.

Fluid is forced from the reservoir 62 through the conduit 160 and into the conduit housing 140, as illustrated by an arrow 300 in FIG. 4. The fluid travels from the conduit housing 140 through the conduits 154 and 150 and into the housing 18, as illustrated by arrows 300 in FIGS. 4 and 5. Also, as shown in FIG. 4, the fluid flow into the housing 18 is applied to the piston 82 and the piston 96, and the cylinders 80 and 100 are moved toward the left. Also, as shown in FIG. 5, fluid flows through the connector conduit 150 into the housing 18. Thus the piston 82 and the piston 96 and the cylinders 100, 80, and 90 are forced toward the left. As this movement occurs, fluid is forced through the passages 77 and 75 and into the main passage 20. Due to the fact that the abutment valve 38 is tapered as shown, fluid flow from the passage 75 forces the abutment valve 38 downwardly, as illustrated in FIG. 4, and fluid flows past the abutment valve 38 and into the tubular valve 30 and into the main passage 20. Fluid flows outwardly from the main passage 20 and into the conduit 126 and flows through the conduit 126 to the reservoir 62.

Thus, it is understood that the power unit 16 of this invention is capable of moving a compaction head for compaction of refuse in a refuse container. The power unit 16 is capable of applying high forces. In fact, during operation of the power unit 16 the power unit 16 is capable of applying increasingly greater fluid forces upon a compaction head for movement thereof.

It is also to be understood that a power unit 16 made according to this invention can be employed in types of environments other than for movement of a compaction head within a refuse container.

Although the preferred embodiment of the power unit of this invention has been described, it will be understood that within the purview of this invention various changes may be made in the form, details, proportion and arrangement of parts, the combination thereof, and the mode of operation, which generally stated consist in a power unit within the scope of the appended claims.

The invention having thus been described the following is claimed:

1. A power unit particularly adapted for movement of a compaction head in a refuse container comprising:

housing means provided with a chamber therein, means within the housing means forming a main passage, means forming a first auxiliary passage leading from the main passage to the chamber of the housing means, means forming a second auxiliary passage leading from the main passage to the chamber of the housing means, a tubular valve within the main passage, the tubular valve being provided with a cylindrical wall having a first opening and a second opening, the openings being spaced apart axially along the cylindrical wall, first spring means, the first spring means normally positioning the tubular valve in a first position in which the first opening of the tubular valve is in communication with the first auxiliary passage, the tubular valve being movable by the first spring means to a second position in which the second opening of the tubular valve is in communication with the second auxiliary passage, an abutment valve within the main passage and in axial alignment with the tubular valve, the tubular valve having an end portion engagable with the abutment valve, the abutment valve being provided with an orifice therethrough which is in communication with the tubular valve, second spring means, the second spring means urging the abutment valve toward the tubular valve, an end wall enclosing the main passage, the end wall having an auxiliary orifice therethrough in communication with the main passage, an auxiliary valve resiliently engaging the end wall and normally closing the auxiliary orifice, a source of fluid, conduit means connecting the source of fluid to the main passage, a fluid return line in communication with the auxiliary orifice for flow of fluid from the auxiliary orifice to the source of fluid, a tubular conduit within the chamber and in communication with the first auxiliary passage, a first piston, the first piston encompassing the tubular conduit, an inner cylinder encompassing the tubular conduit and attached to the first piston, an outer cylinder attached to the first piston and encompassing the inner cylinder and coaxial with first piston and the inner cylinder and spaced from the inner cylinder, a second piston, the second piston being positioned between the outer cylinder and the inner cylinder and coaxial therewith and movable with respect thereto, an actuator cylinder attached to the second piston and positioned between the inner cylinder and the outer cylinder and coaxial therewith and movable with respect thereto, a closure wall attached to the actuator cylinder and enclosing the actuator cylinder, whereby fluid is forced from the source of fluid and through the conduit means and into the main passage and fluid flows into the tubular valve and through the tubular valve and fluid flows from the tubular valve through the first opening thereof, the fluid flowing from the first opening and into the first auxiliary passage and through the first auxiliary passage and into the tubular conduit within the chamber, the fluid engaging the closure wall and also flowing between the inner cylinder and the outer cylinder and engaging the second piston and forcing the second piston and the actuator cylinder and the closure wall in a direction from the housing means, until opposing forces prevent further movement of the second piston and the actuator cylinder and the closure wall in a direction from the housing means, fluid also flowing from the tubular valve through the orifice in the abutment valve and to the end wall, whereby with increased fluid pressure within the main passage, the auxiliary valve is forced to move from the end wall to open the auxiliary orifice and permitting flow of fluid through the orifice in the end wall, whereby the first spring means moves the tubular valve from the first position thereof to the second position thereof and the abutment valve moves with the tubular valve, whereby the cylindrical wall of the tubular valve closes the first auxiliary passage and traps fluid within the chamber which has flowed into the chamber through the first auxiliary passage, the tubular valve in its second position positioning the second opening thereof in communication with the second auxiliary passage for flow of fluid from the tubular valve into the second auxiliary passage and into the chamber, the second auxiliary passage leading to the first piston whereby the fluid flowing into the chamber through the second auxiliary passage engages the first piston and forces movement of the first piston, whereby the first piston moves and applies increased pressure upon the second piston and upon the fluid trapped within the chamber and whereby the first piston and the second piston and the actuator cylinder and the end wall are moved farther in a direction from the housing means.

2. The power unit of claim 1 which includes telescopic fluid conductor means connected to the housing means and to the source of fluid for flow of fluid therebetween.

3. The power unit of claim 1 which includes an auxiliary housing adjacent the housing means, a first conduit, the first conduit being in fluid communication with the outer cylinder and slidably positioned within the auxiliary housing, a second conduit, the second conduit being in fluid communication with the auxiliary housing and the source of fluid, whereby fluid flows between the outer cylinder and the source of fluid as the outer cylinder moves with respect to the housing means.

4. The power unit of claim 1 which includes telescopic fluid conductor means connected to the outer cylinder and to the source of fluid for flow of fluid therebetween.

5. The power unit of claim 1 which includes telescopic fluid conductor means connected to the outer cylinder and to the housing means and to the source of fluid for flow of fluid therebetween.

6. A power unit particularly adapted for movement of a compaction head in a refuse container comprising:

a housing provided with a chamber therein, a first piston within the chamber, an inner cylinder and an outer cylinder within the chamber, the outer cylinder encompassing the inner cylinder, the inner cylinder and the outer cylinder being spaced apart and attached to the first piston and movable therewith, a second piston within the chamber, the second piston being positioned between the outer cylinder and the inner cylinder, the second piston being coaxial with the first piston and the outer cylinder and the inner cylinder, an actuator cylinder within the chamber and attached to the second piston and movable with the second piston, the actuator cylinder having an end portion, enclosing wall means attached to the end portion of the actuator cylinder and enclosing the end portion of the actuator cylinder, means forming a main fluid passage within the housing, means forming a first auxiliary fluid passage leading from the main fluid passage into the chamber and to the first piston, means forming a second auxiliary fluid passage leading from the main fluid passage into the chamber and into the space between the inner cylinder and the outer cylinder and to the second piston, a fluid control member within the main fluid passage controlling flow of fluid from the main fluid passage to the first auxiliary fluid passage and controlling flow of fluid from the main fluid passage to the second auxiliary fluid passage, the fluid control member being movable to a first position in which the first auxiliary fluid passage is closed and the second auxiliary fluid passage is open, the fluid control member being movable to a second position in which the second auxiliary fluid passage is closed and the first auxiliary fluid passage is open, whereby the fluid control member in the first position thereof directs fluid from the main fluid passage into the second auxiliary fluid passage for flow of fluid into the space between the inner cylinder and the outer cylinder and to the second piston, and the fluid control member in the second position thereof closes the second auxiliary fluid passage, thus trapping the fluid applied to the second piston in the space between the inner cylinder and the outer cylinder, the fluid control member in the second position thereof providing fluid communication between the main fluid passage and the first fluid passage for flow of fluid to the first piston for movement thereof and for applying additional fluid pressure to the fluid within the space between the inner cylinder and the outer cylinder, such additional fluid pressure being applied to the second piston by movement of the first piston, which movement of the first piston increases fluid pressure in the space between the inner cylinder and the outer cylinder.

7. A power unit for linear movement of a load, particularly for movement of a packer member or the like, comprising:

a housing provided with a main chamber therein, a first piston within the main chamber, the first piston having a given transverse dimension, a first cylinder, the first cylinder being attached to the first piston coaxial therewith and movable therewith, the first cylinder having an end portion, an end wall attached to the end portion of the first cylinder and closing the end portion of the first cylinder, a second piston, the second piston having a transverse dimension greater than the given transverse dimension of the first piston, a second cylinder, the second cylinder being attached to the second piston coaxial therewith and movable therewith, the second cylinder encompassing the first cylinder and the first piston, a third cylinder, the third cylinder being attached to the second piston and movable therewith, the first cylinder and the first piston encompassing the third cylinder and spaced therefrom and coaxial therewith, there thus being a secondary chamber which is partially enclosed by the second cylinder and the third cylinder and the end wall of the first cylinder, the first piston being within the secondary chamber, a tubular conduit within the main chamber and leading to the secondary chamber, means forming a main fluid passage within the housing, means forming a first auxiliary passage, the first auxiliary passage leading from the main fluid passage to the tubular conduit and to the secondary chamber, means forming a second auxiliary passage, the second auxiliary passage leading from the main fluid passage to the main chamber in the housing, a valve member within the main fluid passage and movable with respect thereto, the valve member being movable to a first position, the valve member in the first position thereof closing the second auxiliary passage and providing fluid communication between the main fluid passage and the first auxiliary passage, the valve member being movable to a second position, the valve member in the second positon thereof closing the first auxiliary passage and providing fluid communication between the main fluid passage and the second auxiliary passage, the valve member in the first position thereof directing fluid flow to the first piston as fluid flows through the main fluid passage into the first auxiliary passage and from the first auxiliary passage into the secondary chamber, and whereby the valve member in the second position thereof closes the first auxiliary fluid passage and opens the second auxiliary fluid passage and directs flow of fluid into the main chamber for movement of the second piston, and whereby the valve member in the second position thereof closes the first auxiliary passage and traps fluid within the secondary chamber as the fluid within the secondary chamber engages the first piston and the end wall of the first cylinder, and whereby movement of the second piston applies increased pressure upon the fluid within the secondary chamber, thus applying increased fluid pressure to the first piston and the end wall of the first cylinder for movement of the first cylinder, and means for attaching a load to the first cylinder for movement of the load.

8. The power unit of claim 7 in which the valve member is tubular.

9. The power unit of claim 7 in which the valve member is movable by fluid pressure applied thereto.

10. The power unit of claim 7 in which the means for attaching a load to the first cylinder includes means for attaching a load to the end wall of the first cylinder.

* * * * *